US006349623B1

(12) United States Patent
Peters

(10) Patent No.: US 6,349,623 B1
(45) Date of Patent: Feb. 26, 2002

(54) SOCKET WRENCH AND SOCKET SET

(75) Inventor: David Peters, West Chester, OH (US)

(73) Assignee: Sawtek, Inc., West Chester, OH (US)

( * ) Notice: Subject to any disclaimer, the term of this patent is extended or adjusted under 35 U.S.C. 154(b) by 0 days.

(21) Appl. No.: 09/547,013

(22) Filed: Apr. 11, 2000

(51) Int. Cl.[7] ..... B25B 23/16
(52) U.S. Cl. ..... 81/177.4; 81/490
(58) Field of Search ..... 81/177.4, 490, 81/124.4

(56) References Cited

U.S. PATENT DOCUMENTS

| | | | | | |
|---|---|---|---|---|---|
| 64,662 | A | * | 5/1867 | Gold | 7/138 |
| 1,381,889 | A | | 6/1921 | Arnold | 81/73 |
| 2,301,945 | A | | 11/1942 | Green | 81/124.1 |
| 4,253,356 | A | * | 3/1981 | Martinmaas | 81/177.4 |
| 4,302,990 | A | * | 12/1981 | Chrichton et al. | 81/60 |
| 4,352,306 | A | | 10/1982 | Martinmaas | 81/177.4 |
| 4,352,307 | A | | 10/1982 | Martinmaas | 81/177.4 |
| 4,627,315 | A | | 12/1986 | Lin | 81/177.4 |
| 4,926,721 | A | | 5/1990 | Hsiao | 81/177.4 |
| 4,960,016 | A | | 10/1990 | Seals | 81/177.4 |
| 5,148,724 | A | | 9/1992 | Rexford | 81/60 |
| 5,421,225 | A | | 6/1995 | Chen | 81/490 |
| 5,704,260 | A | | 1/1998 | Huang | 81/177.4 |

* cited by examiner

*Primary Examiner*—Joseph J. Hail, III
*Assistant Examiner*—David B. Thomas
(74) *Attorney, Agent, or Firm*—Wood, Herron & Evans, LLP

(57) ABSTRACT

A socket set includes a socket wrench having a tapered hollow handle. A tapered tray fits within said handle. The tapered tray holds a plurality of sockets resting on their sides. This enables one to combine the socket set with the wrench so the sockets are always present when needed.

6 Claims, 1 Drawing Sheet

SOCKET WRENCH AND SOCKET SET

BACKGROUND OF THE INVENTION

Socket wrenches, also referred to as ratchet wrenches, have a rectangular drive to rotate a socket which engages a nut or bolthead causing it to rotate. A plurality of sockets are used, each socket having a different size opening to fit a different size nut or bolt. The drive for all the sockets is the same. Generally the sockets are stored separate from the wrench.

However, there are many different types of socket wrenches which have been used which hold or house a plurality of sockets. None of these are particularly efficient. Either they lose a great deal of torque in the design of the overall wrench or the location of the sockets is very inconvenient.

For example, in Martinmaas, U.S. Pat. Nos. 4,253,356 and 4,352,306 disclose a socket set in which the sockets are held in an open handle of the wrench. When one grasps the wrench, they actually grasp the sockets which is particularly uncomfortable and would prevent one from applying a great deal of torque. Lin, U.S. Pat. No. 4,627,315 discloses a wrench socket combination in which the sockets are held in a tray. However the sockets are held in an upright position making the size of the handle very awkward and thus difficult to use.

SUMMARY OF THE INVENTION

The present invention is premised on the realization that a socket wrench having a socket wrench and a set of sockets can be formed wherein the socket wrench simply has a tapered hollow handle which is adapted to hold a plurality of sockets laying on their side and supported in a tray which is also tapered and adapted to fit within the handle. A cap is placed at the end of the handle to hold the tray and the sockets in position. Preferably the tray has a plurality of pairs of fingers which are adapted to grasp the sockets positioned on the tray leaving enough room for an individual to grasp the socket to remove it from the tray. Thus, the present invention is easy to use. It keeps the sockets together and most importantly the socket wrench itself is not so altered as to make it difficult to use.

The objects and advantages of the present invention will be further appreciated in light of the following detailed description and drawings in which:

DETAILED DESCRIPTION

Figure 1:
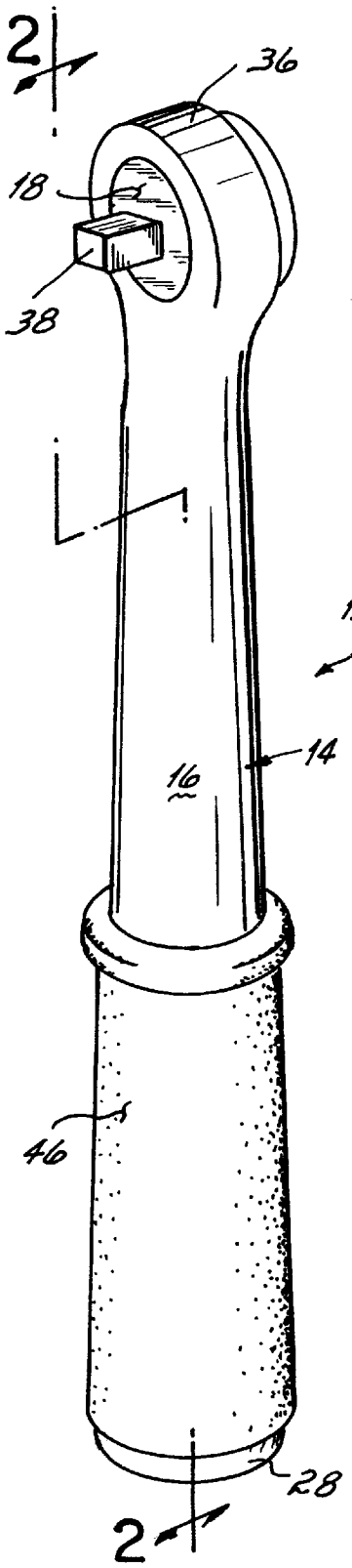
FIG. 1 is a perspective view of the present invention.

As shown more particularly in FIG. 1, the present invention is a socket wrench set 12. The set 12 includes a socket wrench 14 which has a handle 16 and a ratchet drive mechanism 18. The set also includes a plurality of different sockets 22 which are stored together in a plastic tapered tray 24 which fits within the hollowed portion 26 of the handle 16. In turn this is maintained in the handle 16 by a plastic cap 28 which is threaded into an open end 32 of the socket handle 16.

More particularly as shown in the present invention, the tapered handle 16 of socket wrench 14 terminates in a neck

34 which connects to the drive mechanism 18 in the head 36 of the socket wrench 14. Each of the sockets 22 in turn has an opening which corresponds to the size of drive 38 as is typically the case with socket wrenches.

Figure 2:
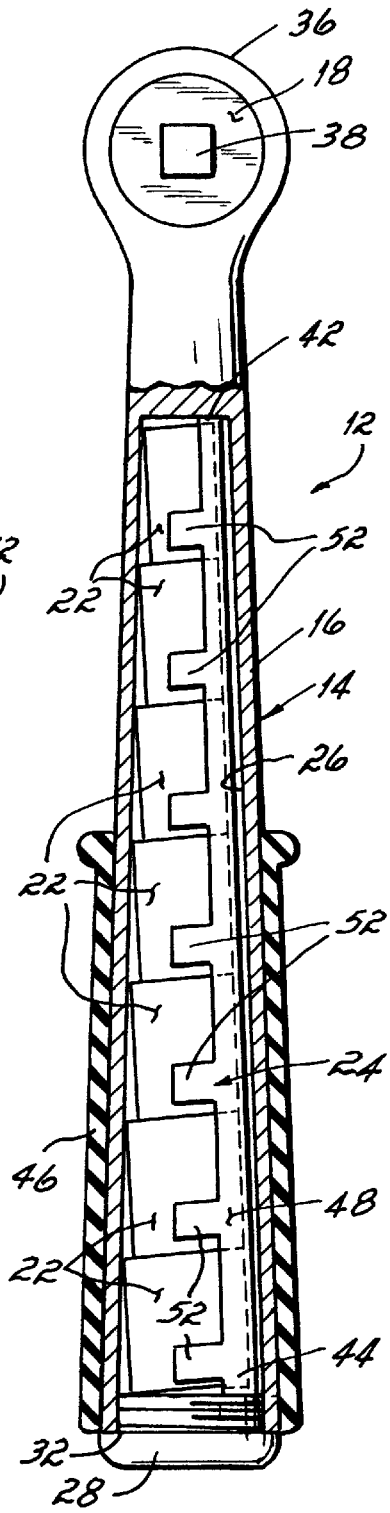
FIG. 2 is a cross-sectional view of the present invention partially in elevation taken at lines 2—2 of FIG. 1.

Each of the different sockets has a different diameter permitting them to be stacked on their sides and positioned in the tray 24. (See FIG. 2.) Thus the socket with the smallest cross-sectional diameter is in a front portion 42 of the tray whereas the socket with the largest cross-sectional diameter is in the rear portion 44 of the tray and the remaining sockets are positioned based on size from front to back. The handle 16 further includes a rubber or plastic grip 46 which encases the outer portion of the handle making it easier to grip.

Figure 3:
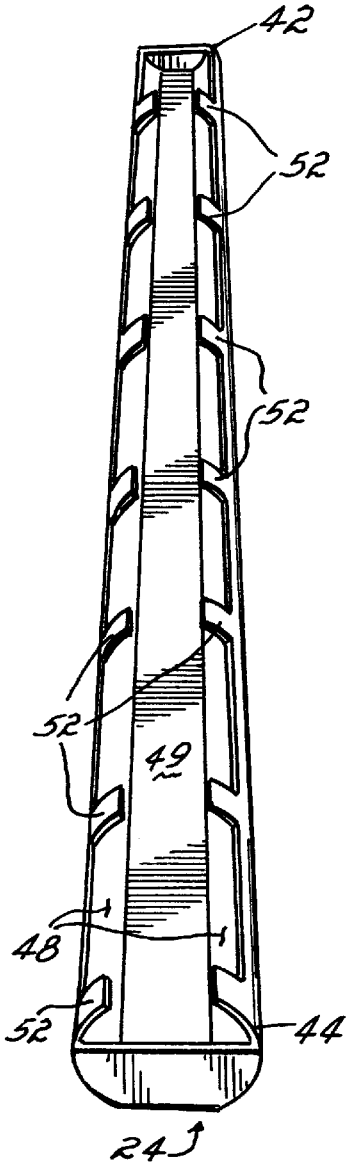
FIG. 3 is a perspective view of the tray used in the present invention.

As shown in FIG. 3, the tray 24 has a rounded tapered lower portion 48. The lower portion is arcuate and is preferably less than 180° radius so that the lower portion is not actually holding the individual sockets. The bottom 49 of the tray is flat so that when the tray itself is removed from the handle, it will rest on a flat surface without rocking. Extending from the bottom portion which is slightly tapered (from bottom to top) are pairs of fingers 52. Each pair of fingers is adapted to grasp one of the sockets so that again the pair of fingers at the front end 42 of the tray 24 are closest together designed to grasp a small socket and the pair of fingers at the far end 44 of the tray 24 are farthest apart adapted to grasp the largest socket. Again the remaining fingers are positioned accordingly to grasp the different size sockets.

When the socket wrench is not being used, the sockets will be snap-fitted on their sides in the tapered tray 24 and positioned in the hollow portion of the handle 16. The cap 28 will close the end of the handle keeping the tray 24 in position. When the socket set is needed, cap 28 is pulled off and the tray 24 pulled out and the necessary socket 22 removed from the tray 24. This will then be put on the drive 38 of the socket wrench 14 and used. When finished, the socket 22 would be placed back in the tray 24, the tray back in the handle and the socket wrench will be ready for storage with all the sockets very neatly held within the wrench.

Thus, the present invention provides a very unique way to hold the sockets with the socket wrench. But most importantly it does not cause an extreme deviation of the shape of the socket wrench. Thus it basically has the same feel as a normal socket wrench because of the shape of the socket handle i.e., tubular.

This has been a description of the present invention along with the preferred method of practicing the present invention. However, the invention itself should only be defined by the appended claims wherein.

I claim:

1. A socket set comprising a socket wrench having a tapered hollow handle and an end cap sealing a large end of said handle;

a plurality of sockets each having a round side surface, and each having a different outermost diameter and adapted to snap onto said socket wrench;

a tray said tray having a tapered shape and a rounded bottom surface and having a plurality of spaces adapted to hold said sockets resting on their sides;

said tray holding said socket is fitted within said handle and wherein said handle completely surrounding said sockets and said tray.

2. The socket set claimed in claim 1 wherein said tray has a plurality of pairs of fingers each pair of fingers adapted to hold to one of said sockets in said tray.

3. The socket set claimed in claim 2 wherein said pairs of fingers are spaced to enable an individual to grasp a socket in an area between adjacent pairs of fingers.

4. The socket set claimed in claim 1 wherein said tray is plastic.

5. The socket set claimed in claim 1 wherein said handle is a generally rounded handle.

6. A socket set comprising a socket wrench having a tapered hollow handle and an end cap sealing a large end of said handle;

a plurality of sockets each having a round side surface and adapted to snap onto said ratchet wrench;

a tray, said tray having a tapered shape and a rounded bottom surface and a plurality of spaces adapted to hold said sockets resting on their sides said tray having a plurality of pairs of fingers spaced from each other to enable an individual to grasp a socket in an area between adjacent pairs of fingers;

wherein said tray holding said sockets resting on their sides is fitted within said hollow handle and completely surrounded by said handle.

* * * * *